US012638200B2

(12) United States Patent
Sinha et al.

(10) Patent No.: US 12,638,200 B2
(45) Date of Patent: May 26, 2026

(54) AIRBORNE CONTAMINANT DETECTION AND LOCALIZATION IN DUCTING SYSTEMS

(71) Applicant: Carrier Corporation, Palm Beach Gardens, FL (US)

(72) Inventors: Saurabh Kumar Sinha, Hyderabad (IN); Ankit Sarin, Hyderabad (IN); Lasya A, Hyderabad (IN); Srinivas Mulkala, Hyderabad (IN); Ganapuram Ranjith Kumar, Hyderabad (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 598 days.

(21) Appl. No.: 18/151,567

(22) Filed: Jan. 9, 2023

(65) Prior Publication Data

US 2023/0235905 A1 Jul. 27, 2023

Related U.S. Application Data

(60) Provisional application No. 63/302,187, filed on Jan. 24, 2022.

(51) Int. Cl.
*F24F 11/30* (2018.01)
*F24F 7/04* (2006.01)
(Continued)

(52) U.S. Cl.
CPC ..... *F24F 11/30* (2018.01); *F24F 7/04* (2013.01); *F24F 11/89* (2018.01); *F24F 2110/65* (2018.01); *F24F 2110/66* (2018.01)

(58) Field of Classification Search
CPC .... F24F 11/30; F24F 11/89; F24F 7/04; F24F 2110/65; F24F 2110/66
(Continued)

(56) References Cited

U.S. PATENT DOCUMENTS 5,394,934 A 3/1995 Rein et al.
8,981,950 B1 3/2015 Kates
(Continued)

FOREIGN PATENT DOCUMENTS

CN 109540978 A 3/2019
CN 111353257 A 6/2020
(Continued)

OTHER PUBLICATIONS

Extended European Search Report; EP Application No. 23153055.1-1001; dated Jun. 14, 2023; 9 pages.
(Continued)

*Primary Examiner* — Steven B Mcallister
*Assistant Examiner* — Dana K Tighe
(74) *Attorney, Agent, or Firm* — CANTOR COLBURN LLP

(57) ABSTRACT

Airborne contaminant detection and localization systems include an HVAC system having a duct, a first vent connected to a first indoor space, and a second vent fluidly connected to a second indoor space, with the second vent being downstream from the first vent in a flow direction along the duct. A monitoring system includes a first and second sensor elements arranged proximate the first and second vents, respectively, the sensor elements configured to detect one or more airborne contaminants. A central unit receives sensor data from the sensor elements. The central unit includes information regarding a location of each of the sensor elements within the duct. The central unit determines the presence and intensity of an airborne contaminant in the duct from the sensor data and establishes a detection zone that includes a portion of the vent having a highest detected intensity of the airborne contaminant.

20 Claims, 3 Drawing Sheets

(51) Int. Cl.
*F24F 11/89* (2018.01)
*F24F 110/65* (2018.01)
*F24F 110/66* (2018.01)

(58) Field of Classification Search
USPC ..... 454/228
See application file for complete search history.

(56) References Cited

U.S. PATENT DOCUMENTS

| | | | | |
|---|---|---|---|---|
| 9,182,751 | B1 | 11/2015 | Reeder | |
| 9,347,678 | B2 | 5/2016 | Stakutis et al. | |
| 9,835,602 | B2 | 12/2017 | Brasfield | |
| 10,509,377 | B2 | 12/2019 | Willette et al. | |
| 10,690,363 | B2 * | 6/2020 | Coogan | F24F 7/06 |
| 11,156,997 | B2 | 10/2021 | Casa | |
| 11,268,714 | B2 * | 3/2022 | Johnson | F24F 11/54 |
| 2008/0182506 | A1 | 7/2008 | Jackson et al. | |
| 2014/0238107 | A1 | 8/2014 | Chou et al. | |
| 2014/0349566 | A1 * | 11/2014 | Lamb | F24F 11/76 454/258 |
| 2015/0140919 | A1 | 5/2015 | Zwijack | |
| 2016/0116181 | A1 | 4/2016 | Aultman et al. | |
| 2019/0346417 | A1 | 11/2019 | Benefield | |
| 2020/0116377 | A1 * | 4/2020 | Heintzelman | F24F 11/59 |
| 2020/0141608 | A1 * | 5/2020 | Sinha | F24F 11/65 |
| 2022/0010996 | A1 | 1/2022 | Carrieri | |
| 2022/0026101 | A1 * | 1/2022 | Ko | F24F 11/88 |
| 2022/0042694 | A1 * | 2/2022 | He | F24F 11/30 |
| 2023/0009166 | A1 * | 1/2023 | Xu | F24F 11/70 |

FOREIGN PATENT DOCUMENTS

| | | | |
|---|---|---|---|
| CN | 111401129 | A | 7/2020 |
| CN | 112413855 | A | 2/2021 |
| CN | 112578083 | A | 3/2021 |
| EP | 0632268 | A1 | 1/1995 |
| JP | 4520000 | B2 | 8/2010 |
| WO | 2020128914 | A1 | 6/2020 |

OTHER PUBLICATIONS

European OA for application EP 231536055.1, Issued Jun. 11, 2025 in U303404EP, 59 pages.

* cited by examiner

AIRBORNE CONTAMINANT DETECTION AND LOCALIZATION IN DUCTING SYSTEMS

CROSS-REFERENCE TO RELATED APPLICATIONS

This application claims the benefit of U.S. Provisional Application Ser. No. 63/302,187, filed Jan. 24, 2022, the disclosure of which is incorporated herein by reference in its entirety.

BACKGROUND

The subject matter disclosed herein generally relates to heating, ventilation, and air conditioning (HVAC) systems and, more particularly, to airborne contaminant detection and localization within HVAC systems and enclosed spaces.

In current HVAC system, there is no integrated solution to detect and locate foul odors within the HVAC system and/or in spaces that are connected to such HVAC systems (e.g., indoor spaces as well as in the ducting of the HVAC system). Such lack of detection may lead to poor air quality and/or cause health problems for persons within the spaces connected to such HVAC systems. Such health problems may include, without limitation, tiredness, inability to concentrate, and illness such as coughing, sneezing, and other breathing problems. Accordingly, improved HVAC systems for detection and localization of odors or other airborne contaminants (e.g., gases, particulates, odors, etc.).

SUMMARY

According to some embodiments, airborne contaminant detection and localization systems are provided. The systems include a heating, ventilation, and air conditioning (HVAC) system having a duct configured to convey air therethrough. A first vent is configured to fluidly connect the duct to a first indoor space of the one or more indoor spaces and a second vent is configured to fluid connect the duct to a second indoor space of the one or more indoor spaces. The second indoor space is different from the first indoor space and the second vent is located downstream from the first vent in a flow direction along the duct. A monitoring system includes a first sensor element arranged proximate the first vent, the first sensor element configured to detect one or more airborne contaminants and a second sensor element arranged proximate the second vent, the second sensor element configured to detect the one or more airborne contaminants. A central unit is configured to receive sensor data from the first sensor element and the second sensor element, wherein the central unit includes information regarding a location of each of the first sensor element and the second sensor element within the duct. The central unit is configured to determine the presence of an airborne contaminant in the duct from the sensor data, determine an intensity of the airborne contaminant at each of the first sensor element and the second sensor element, establish a detection zone that includes a portion of the vent having a highest detected intensity of the airborne contaminant, and generate an alert comprising the detection of the airborne contaminant and the detection zone.

In addition to one or more of the features described herein, or as an alternative, further embodiments of the airborne contaminant detection and localization systems may include that the central unit is configured to compare an intensity of a detected airborne contaminant at each of the first sensor element and the second sensor element to determine a location of a source of the airborne contaminant.

In addition to one or more of the features described herein, or as an alternative, further embodiments of the airborne contaminant detection and localization systems may include that the duct is a supply duct and the system further includes a return duct, a first return vent configured to direct air from the first indoor space into the return duct, and a second return vent configured to direct air from the second indoor space into the return duct. The monitoring system further includes a third sensor element arranged proximate the first return vent, the third sensor element configured to detect the one or more airborne contaminants, a fourth sensor element arranged proximate the second return vent, the fourth sensor element configured to detect the one or more airborne contaminants, and the central unit is configured to determine a source of the detected airborne contaminant based on sensor data from the first, second, third, and fourth sensor elements.

In addition to one or more of the features described herein, or as an alternative, further embodiments of the airborne contaminant detection and localization systems may include that each of the first sensor element and the second sensor element comprise a respective sensor array.

In addition to one or more of the features described herein, or as an alternative, further embodiments of the airborne contaminant detection and localization systems may include that each of the first sensor element and the second sensor element are configured to detect the presence of at least one of $NO_x$, $H_2S$, $CH_4$ (methane), Ammonia, Methanethiol, Phosgene, $SO_x$, Chlorine, or Volatile Organic Compounds.

In addition to one or more of the features described herein, or as an alternative, further embodiments of the airborne contaminant detection and localization systems may include a plurality of additional sensor elements arranged in the duct and a plurality of additional vents, wherein each vent of the plurality of additional vents has one sensor element of the plurality of additional sensor elements associated therewith.

In addition to one or more of the features described herein, or as an alternative, further embodiments of the airborne contaminant detection and localization systems may include that the first sensor element is arranged upstream from the first vent and the second sensor element is arranged upstream from the second vent.

In addition to one or more of the features described herein, or as an alternative, further embodiments of the airborne contaminant detection and localization systems may include that the first sensor element is arranged downstream from the first vent and the second sensor element is arranged downstream from the second vent.

In addition to one or more of the features described herein, or as an alternative, further embodiments of the airborne contaminant detection and localization systems may include that the central unit includes a database of the position and location of each of the first sensor element and the second sensor element as mapped to a ducting model representing the duct.

In addition to one or more of the features described herein, or as an alternative, further embodiments of the airborne contaminant detection and localization systems may include that the one or more airborne contaminants include at least one odor.

In addition to one or more of the features described herein, or as an alternative, further embodiments of the airborne contaminant detection and localization systems may include that the duct is a supply duct of the HVAC system.

According to some embodiments, methods of detecting and identifying a location of an airborne contaminant within a heating, ventilation, and air conditioning (HVAC) system are provided. The methods include monitoring a first detection zone of a duct with a first sensor element, the first detection zone comprising a first section of the duct, the first sensor element, and at least one first vent, wherein the at least one first vent is configured to provide fluid connection between the duct and a first indoor space, monitoring a second detection zone of the duct with a second sensor element, the second detection zone comprising a second section of the duct, the second sensor element, and at least one second vent, wherein the at least one second vent is configured to provide fluid connection between the duct and a second indoor space, mapping locations of the first sensor element and the second sensor element within the vent, determining the presence of an airborne contaminant within at least one of the first detection zone and the second detection zone based on sensor data received from the respective first sensor element and second sensor element, determining an intensity level of the airborne contaminant, and generating an alert including a detection zone having a highest intensity level from the first detection zone and the second detection zone.

In addition to one or more of the features described herein, or as an alternative, further embodiments of the methods may include comparing an intensity of a detected airborne contaminant at each of the first sensor element and the second sensor element to determine a location of a source of the airborne contaminant.

In addition to one or more of the features described herein, or as an alternative, further embodiments of the methods may include that the HVAC system comprises a return duct, a first return vent configured to direct air from the first indoor space into the return duct, and a second return vent configured to direct air from the second indoor space into the return duct. The method further includes monitoring a first detection zone of the return duct with a third sensor element, the first detection zone of the return duct comprising a first section of the return duct, the third sensor element, and at least one first return vent, wherein the at least one first return vent is configured to direct air from the first indoor space into the return duct, monitoring a second detection zone of the return duct with a fourth sensor element, the second detection zone of the return duct comprising a second section of the return duct, the fourth sensor element, and at least one second return vent, wherein the at least one second return vent is configured to direct air from the second indoor space into the return duct, and determining a source of the detected airborne contaminant based on sensor data from the first, second, third, and fourth sensor elements.

In addition to one or more of the features described herein, or as an alternative, further embodiments of the methods may include that each of the first sensor element and the second sensor element comprise a respective sensor array.

In addition to one or more of the features described herein, or as an alternative, further embodiments of the methods may include that each of the first sensor element and the second sensor element are configured to detect the presence of at least one of $NO_x$, $H_2S$, $CH_4$ (methane), Ammonia, Methanethiol, Phosgene, $SO_x$, Chlorine, or Volatile Organic Compounds.

In addition to one or more of the features described herein, or as an alternative, further embodiments of the methods may include a plurality of additional sensor elements arranged in the duct and a plurality of additional vents, wherein each vent of the plurality of additional vents has one sensor element of the plurality of additional sensor elements associated therewith.

In addition to one or more of the features described herein, or as an alternative, further embodiments of the methods may include mapping and generating a database of a position and location of each of the first sensor element and the second sensor element as mapped to a ducting model representing the duct.

In addition to one or more of the features described herein, or as an alternative, further embodiments of the methods may include that the one or more airborne contaminants include at least one odor.

In addition to one or more of the features described herein, or as an alternative, further embodiments of the methods may include that the duct is a supply duct of the HVAC system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
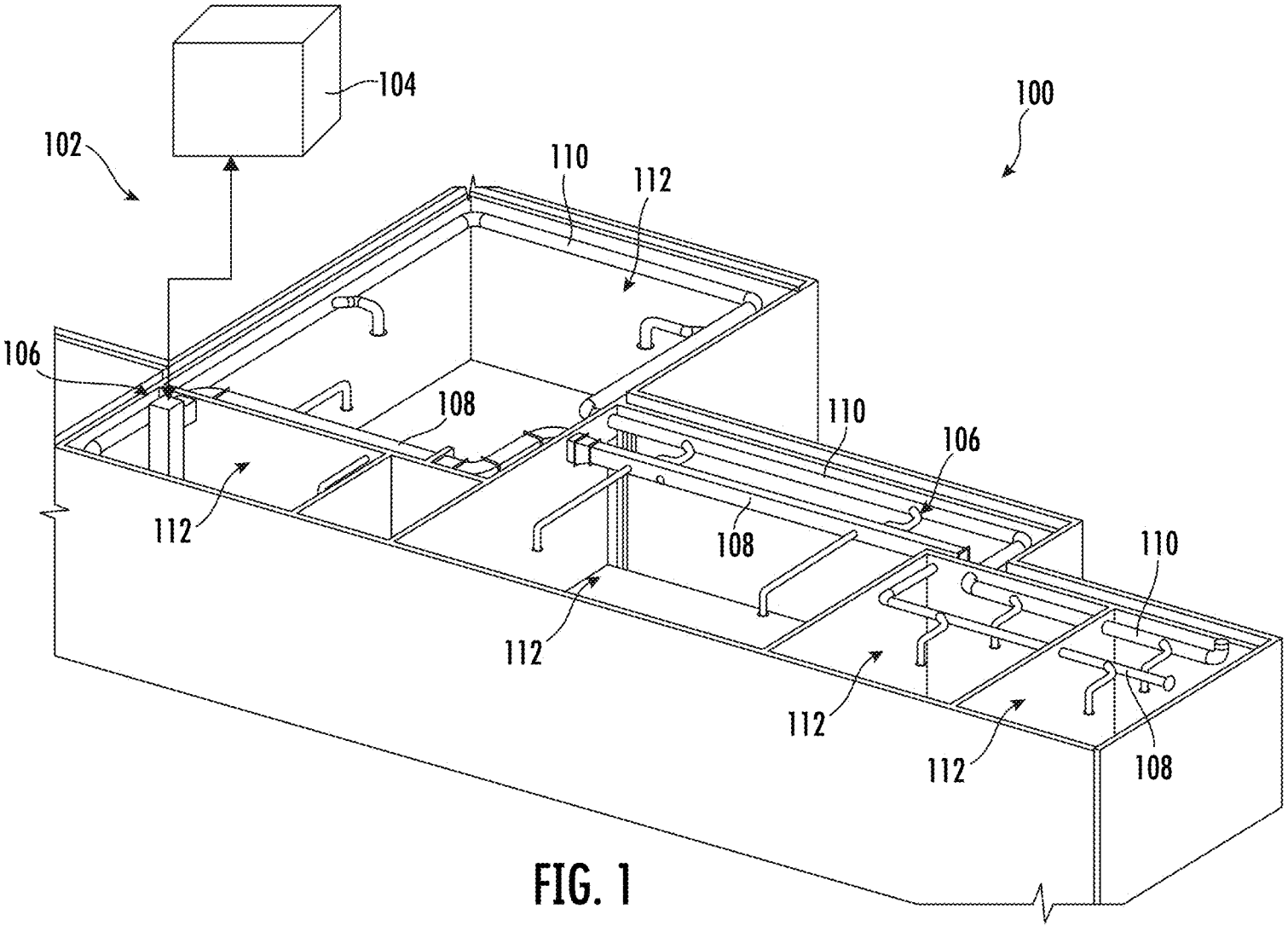
FIG. 1 is a schematic illustration of a building having an HVAC system that can incorporate embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Referring to FIG. 1, a schematic illustration of a building 100 having a heating, ventilation, and air conditioning (HVAC) system 102 that may incorporate embodiments of the present disclosure is shown. The HVAC system 102 includes an HVAC unit 104 configured to treat air and direct the treated air into a ducting system 106 having a supply duct 108 and a return duct 110 configured to supply air into and return air from one or more interior spaces 112 of the building 100.

In current HVAC systems, there is no integrated solution to detect and locate foul/unpleasant odors and/or other airborne contaminants in an interior space (e.g., within rooms of a building as well as within an associated HVAC ducting system). Such airborne contaminants can lead to poor air quality and potentially health problems for occupants within the interior spaces Such issues can include, without limitation, tiredness, inability to concentrate, coughing, sneezing, allergies, and other breathing problems etc. and the like. In HVAC ducting systems, the source of airborne contaminants (including foul odors) can be due to various different causes. For example, an HVAC ducting system may be a breeding ground for mildew, green algae, and molds to grow, propagate and establish colonies. Such biological growths can create airborne constituents and/or particles which can result in unpleasant odors and negative health impacts to occupants of the indoor spaces. Further, other (larger) biological entities may enter such ducts, such as insects, rodents, birds, reptiles, and other animals. The presence of such animals (e.g., living, nesting, etc.) may cause airborne contaminants to enter the HVAC air stream and be delivered into indoor spaces. Further, any such animals that die within the ducting (or within the interior spaces) can generate additional odors, foul smells, and/or airborne contaminants.

Additionally, decaying food within the ducting and/or the indoor spaces can cause additional odors, airborne contaminants, and the like. For example, food taken by rodents and/or birds within HVAC ducting system and leftover in the ducting pathway. Further, if occupants leave food within the indoor spaces (e.g., a kitchen or office), such food can generate mold or otherwise generate unpleasant odors and/or airborne contaminants. Additionally, various aspects of the building and/or HVAC system may cause foul odors and/or generate airborne contaminants. For example, coagulated air filters inside the ducting system can produce bad or pungent odors and/or generate other airborne contaminants. Additionally, circuitry, circuit boards, motors (e.g., fan motors), and other electrical and/or electronic equipment within the ducting or otherwise in fluid communication with the HVAC air stream can produce various airborne contaminants (e.g., shorts-out can produce burning odors and particulates). Lubrication oil and/or crude oil can leak-out or spill-over from fan motors, damper motors, or other mechanical components that are present in the ducting system or otherwise associated with the HVAC system. Ruptured sewer pipes or other piping systems (e.g., liquids and/or gas) somewhere near or in the duct system can produce pungent odors and/or release gases or other airborne contaminants into the HVAC system.

In view of this, embodiments of the present disclosure are directed to monitoring systems that are integrated into the HVAC system and building systems to provide identification and localization of sources of airborne contaminants. In accordance with some embodiments of the present disclosure, a building floor plan layout is integrated with a building information model (e.g., BIM/CAD) layout application. From this, the routing, layout, airflow path, ducting and the like may be known and tied directly into information obtained in accordance with embodiments of the present disclosure. From this integration of the layout of the HVAC ducting system, monitoring for the source and location of airborne contaminants within the HVAC system may be performed.

In accordance with embodiments of the present disclosure, a distributed system of sensors or sensor arrays may be positioned within the HVAC system ducting to monitor for airborne contaminants. As such, the HVAC system may be continuously monitored for bad order severity and intensity along with identification of sources and location of airborne contaminants and the like. In accordance with some embodiments of the present disclosure, and without limitation, sensors array infrastructure can include sensor arrays can have, for example, and without limitation, $NO_x$, $H_2S$, $CH_4$ (methane), Ammonia, Methanethiol, Phosgene, $SO_x$, Chlorine, Volatile Organic Compounds, harmful gases, and other indoor air quality ("IAQ") sensors that are integrated together to perform a monitoring of HVAC ducting (both supply and return air flows).

In operation, embodiments of the present disclosure enable diagnostic information collection which may be analyzed to determine the location, source, and type of airborne contaminant present within an HVAC ducting (or within an indoor space fluidly coupled to the HVAC ducting). In some configurations, the diagnostic information (e.g., normal, alarm, and Alert) can be sent to a HVAC control panel and/or otherwise displayed (e.g., on local thermostat of the indoor space). In addition to local notification (e.g., display on a thermostat or other display within a given indoor space), the diagnostic information may be transmitted to a building management system or the like, through wired or wireless communication. For example, upon detection of airborne contaminants (e.g., particulates, specific compounds/chemicals/molecules, odors, etc.) are detected, the monitoring system can generate and send an alert to a service technician (e.g., via cloud) along with the information of a ducting zone or other identifier regarding the location, probably source, and intensity of the detected airborne contaminants. Advantageously, navigational guidance to an exact location of the source of the airborne contaminant along with required diagnostics information can be generated and supplied substantially instantaneously upon detection.

Figure 2:
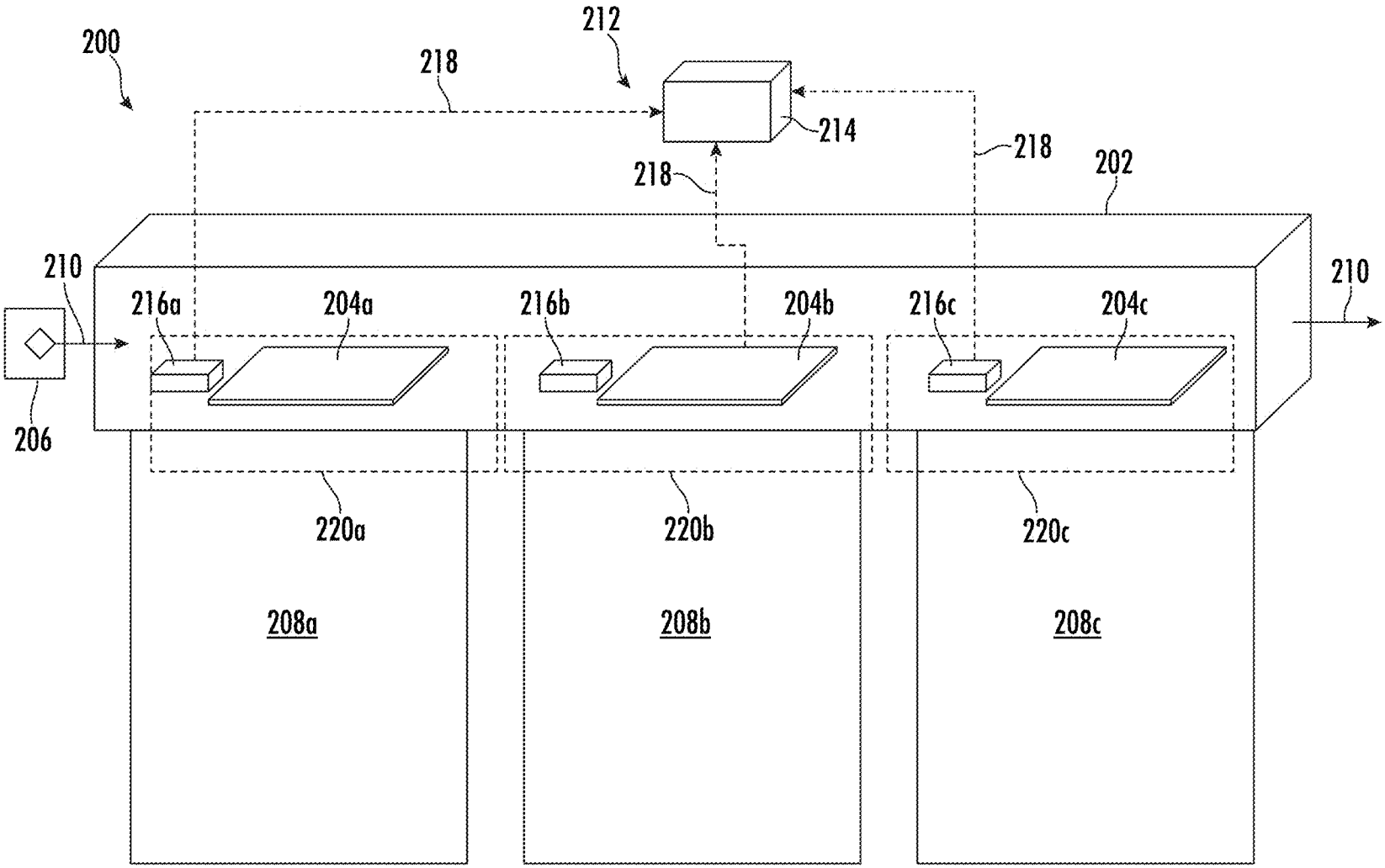
FIG. 2 is a schematic illustration of an airborne contaminant detection and localization system in accordance with an embodiment of the present disclosure.

Referring now to FIG. 2, a schematic illustration of an airborne contaminant detection and localization system 200 in accordance with an embodiment of the present disclosure is shown. The airborne contaminant detection and localization system 200 includes an HVAC duct 202 along which may be one or more supply vents 204*a*, 204*b*, 204*c* (collectively referred to as supply vents 204). Air is supplied into the HVAC duct 202 from an air conditioner or other HVAC supply system 206. The HVAC supply system 206 can include compressors, motors, pumps, fans, filters, and the like as will be appreciated by those of skill in the art. The HVAC supply system 206 is configured to pump a flow of air into the duct 202 and through the supply vents 204 to supply conditioned air into one or more indoor spaces 208 (illustratively shown as indoor spaces 208*a*. 208*b*, 208*c* to correspond to the supply vents 204*a*, 204*b*, 204*c*). The supply vents 204 may refer generally to diffusers, vents, fan-powered venting, and the like that are arranged to enable air from the duct 202 to enter the respective indoor spaces 208. The air is directed in a flow direction 210, illustratively shown in FIG. 2 by an arrow originating from the HVAC supply system 206 (i.e., left-to-right on the page of FIG. 2).

The indoor spaces 208*a*, 208*b*, 208*c* may be representative of rooms, enclosed spaces, other spaces that are supplied with air from the HVAC supply system 206 (e.g., rooms of a building).

The airborne contaminant detection and localization system 200 includes a monitoring system 212 that is configured to monitor the air passing through the HVAC duct 202 to monitor for the presence of airborne contaminants, such as gases, particulates, odors, chemicals, compounds, molecules, and the like, that may cause unpleasant odors and/or negatively impact the air quality provided by the HVAC supply system 206. The monitoring system 212 includes a central unit 214 that is operably connected to or in communication with one or more sensor elements 216 (illustratively shown as 216*a*, 216*b*, 216*c*) through a sensor connection 218 (e.g., wired or wireless connection). The sensor elements 216 may be single sensors/detectors or an array of sensors/detectors. The sensor elements 216 are configured to detect airborne contaminants that are present within the duct 202. The sensor elements 216 may be configured to detect one or more airborne contaminants and detect levels of such detected airborne contaminants.

As illustratively shown, the sensor elements 216 are arranged upstream of a respective supply vent 204 in the flow direction 210. The central unit 214 may be configured with location information for each sensor element 216, such that data received from a given sensor element 216 may be assigned location data thereto. As such, the readings or detected levels (sensor data) sent from the sensor elements 216 to the central unit 214 may be localized or positioned within the duct 202 and relative to the building or, at least, relative to the indoor spaces 208. It will be appreciated that a given duct can supply air to more than (or less than) three indoor spaces and/or provide air through multiple supply vents 204 for a single indoor space 208. That is, it will be appreciated that a given duct system may include any number of supply vents and/or sensor elements, without departing from the scope of the present disclosure.

In operation, the central unit 214 is configured with the location data of each sensor element 216. As such, if an airborne contaminant is detected within the duct 202, the central unit 214 can identify (at least approximately) the location of the source of such airborne contaminant. For example, if an airborne contaminant is detected at a given sensor element 216, the intensity and location of the detected airborne contaminant may be obtained. For example, through the intensity and location information, a plot or data set of strength and location of an airborne contaminant may be obtained. For example, if a relatively high detection is made at the second sensor element 216*b* (in the flow direction 210), no airborne contaminant is detected at the first sensor element 216*a*, and a relatively lower concentration of airborne contaminant is detected at the third sensor element 216*c*, then it can be determined that a source of the airborne contaminant is present downstream of the first sensor element 216*a* and upstream of the second sensor element 216*b*. The central unit 214 can generate a notification of the presence of an airborne contaminant inside the supply duct system proximate (e.g., upstream) the second sensor element 216*b*, having the highest intensity of airborne contaminant in the flow direction 210.

From the location of the sensor elements 216, detection zones 220 (illustratively shown as detection zones 220*a*, 220*b*, 220*c*) may be established, with each zone comprising a single sensor element 216. From this, zone information may be established regarding the detection of an airborne contaminant within the duct 202. The detection zones 220 may include information regarding the duct 202 along with the associated indoor spaces 208 that are serviced by a given section of the duct 202. As such, the zone information can identify both a section of duct 202 that may include a source of airborne contaminants and one or more indoor spaces 208 that are fluidly connected to the duct 202 within the detection zone 220.

Figure 3:
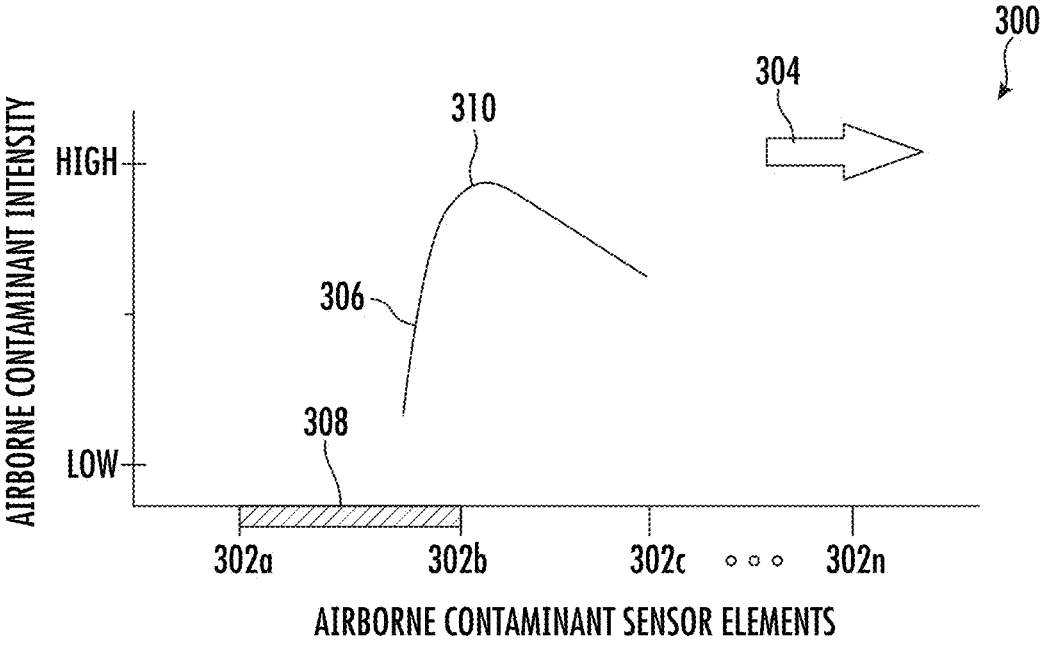
FIG. 3 is a plot representative of data collection associated with an airborne contaminant detection and localization system in accordance with an embodiment of the present disclosure.

Turning now to FIG. 3, a schematic plot 300 representative of data collection associated with an airborne contaminant detection and localization system in accordance with an embodiment of the present disclosure is shown. On the horizontal axis are airborne contaminant sensor elements 302*a*, 302*b*, 302*c* . . . 302*n*, arranged in a flow direction 304 within a duct of an HVAC system. In this configuration, a first airborne contaminant sensor element 302*a* is located upstream of a second airborne contaminant sensor element 302*b*, the second airborne contaminant sensor element 302*b* is located upstream of a third airborne contaminant sensor element 302*c*, etc. On the vertical axis is a relative scale (low to high) of airborne contaminant intensity as detected by the respective airborne contaminant sensor elements 302*a-n*. The scaling of the airborne contaminant intensity may be numerical (e.g., parts per million, parts per billion) or a mere low to high based on activity or detection at a given airborne contaminant sensor elements 302*a-n*.

In the plot 300, an intensity curve 306 is illustratively shown. The intensity curve 306 illustrates an airborne contaminant intensity as detected by one or more of the airborne contaminant sensor elements 302*a-n*. For example, in this illustrative embodiment, the intensity of the airborne contaminant starts downstream from the first airborne contaminant sensor element 302*a* (i.e., no detected presence/intensity at the first airborne contaminant sensor element 302*a*). However, at the second airborne contaminant sensor element 302*b*, the airborne contaminant intensity has a peak intensity 310. The airborne contaminant intensity then decreases by the third airborne contaminant sensor element 302*c* and may be gone by a fourth airborne contaminant sensor element or may continue to decrease in intensity in the flow direction 304. From this, a detected airborne contaminant zone 308 may be identified. The identified detected airborne contaminant zone 308 may include information of where within the ducting and/or HVAC system that the second airborne contaminant sensor element 302*b* is located and any associated indoor spaces that are arranged upstream from the second airborne contaminant sensor element 302*b* in the flow direction 304. It will be appreciated that the flow direction 304 may be representative of a supply flow or a return flow, and thus the associated sensor elements may be arranged within supply air ducting or return air ducting, and the directional arrow (flow direction 304) is merely indicative of a direction of flow relative to the sensors within the ducting.

Figure 4:
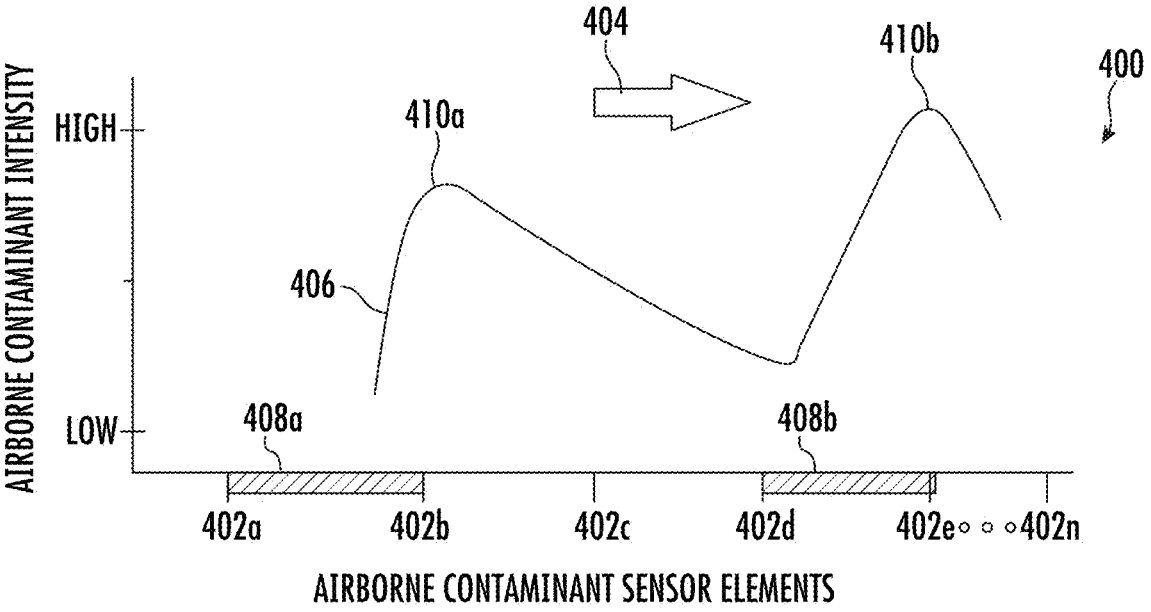
FIG. 4 is a plot representative of data collection associated with an airborne contaminant detection and localization system in accordance with an embodiment of the present disclosure.

Turning now to FIG. 4, a schematic plot 400 representative of data collection associated with an airborne contaminant detection and localization system in accordance with an embodiment of the present disclosure is shown. On the horizontal axis are airborne contaminant sensor elements 402*a*, 402*b*, 402*c*, 402*d*, 402*e*, . . . 402*n*, arranged in a flow direction 404 within a duct of an HVAC system. In this configuration, a first airborne contaminant sensor element 402*a* is located upstream of a second airborne contaminant sensor element 402*b*, the second airborne contaminant sensor element 402*b* is located upstream of a third airborne contaminant sensor element 402*c*, etc. On the vertical axis is a relative scale (low to high) of airborne contaminant intensity as detected by the respective airborne contaminant sensor elements 402*a-n*.

In the plot 400, an intensity curve 406 is illustratively shown. The intensity curve 406 illustrates an airborne contaminant intensity as detected by one or more of the airborne contaminant sensor elements 402*a-n*. For example, in this illustrative embodiment, the intensity of the airborne contaminant starts downstream from the first airborne contaminant sensor element 402*a* (i.e., no detected presence/intensity at the first airborne contaminant sensor element 402*a*). However, at the second airborne contaminant sensor element 402*b*, the airborne contaminant intensity has a peak intensity 410*a*. The airborne contaminant intensity then decreases by the third airborne contaminant sensor element 402*c* and is nearly gone by a fourth airborne contaminant sensor element 402*d*. In contrast, to the plot 300 of FIG. 3, in this embodiment, a fifth airborne contaminant sensor element 402*e* detects a second peak intensity 410*b* or increase in an airborne contaminant (which may be the same or a different airborne contaminant from that detected at the second airborne contaminant sensor element 402*b*). From this, detected airborne contaminant zones 408*a*, 408*b* may be identified. The identified detected airborne contaminant zones 408*a*, 408*b* may include information of where within the ducting and/or HVAC system that the respective airborne contaminant sensor elements 402*b*, 402*e* are located and any associated indoor spaces that are arranged upstream from the respective airborne contaminant sensor elements 402*b*, 402*e* in the flow direction 404.

From this, it will be appreciated that the location of specific sources of airborne contaminants may be identified and thus targeted resolution may be achieved. For example, from the plot 400, a central unit may be configured to send information regarding the location(s) of the detected airborne contaminants, and thus a service professional may save time and effort by being directed to the appropriate locations along the HVAC flow path (e.g., ducting system and associated indoor spaces). Because peaks 410*a-b* can be identified and associated with specific airborne contaminant sensor elements 402*b*, 402*e*, only specific airborne contaminant zones 408*a*, 408*b* and thus specific sections of the ducting may be required, thus saving time and money. It will be appreciated that the flow direction 404 may be representative of a supply flow or a return flow, and thus the associated sensor elements may be arranged within supply air ducting or return air ducting, and the directional arrow (flow direction 404) is merely indicative of a direction of flow relative to the sensors within the ducting.

It will be appreciated that the above described process and system may be used in both supply and return ducting of an HVAC system. The flow direction in the illustrative configurations of FIGS. 2-4 may be representative of a supply flow or a return flow. Further, although described and shown in FIG. 2 with the sensor elements 216 arranged upstream of a respective supply vent 204 (or return vent), it will be appreciated that in some embodiments, the sensor elements may be arranged downstream of a respective supply (or return) vent. Further, in some embodiments, sensor elements may be arranged both upstream and downstream relative to a given supply (or return) vent. Such dual-sensor configuration can enable detection of airborne contaminants that are sourced from a given indoor space, thus providing improved identification and localization of the source of airborne contaminants. For example, referring back to FIG. 1, sensor elements may be disposed within both the supply duct 108 and a return duct 110.

It will be appreciated that embodiments of the present disclosure may be used to accurately pinpoint or locate the position of a source of airborne contaminant. For example, in some embodiments, a source of bad odor/contaminants in a return air duct may be determined when there is no bad odor/contaminant detected by a sensor within a specific indoor environment, but such bad odor/contaminant is detected by sensors in a return air duct of that particular zone. In this case, the identified source of the bad odor/contaminants is not present in the zone consisting of the supply air duct or the associated indoor environment/space itself, and thus can be determined to have the source only within the return duct. It will be appreciated that in some such situations, a downstream return air duct sensor may detect the presence of such bad odor/contaminants at a lower intensity level, further aiding in identification of the location of the source of the bad odor/contaminants.

Further, a source of bad odor/contaminants may be located within an indoor environment/space covered by a particular zone of sensors. If the bad odor/contaminants are detected by the sensors kept within an indoor environment itself, and bad odor is detected by the sensors in a return air duct of that zone but there is no detection from a supply air duct sensor of that zone, it can be concluded or determined that the source is within the indoor space itself.

In accordance with some embodiments of the present disclosure, system described herein can recursively monitor for multiple bad odor/contaminant sources. In a case of multiple alarm/alerts (e.g., from a particular zone-supply duct alarm, indoor environment alarm, and return duct alarm- or a combination thereof), a preferential order of indicated location/zone may be generated. For example, and without limitation, a first preference may be given to the supply air ducting system alarm for a particular zone, a second preference may be given to the indoor space itself for that particular zone, and third preference may be given to the return air duct for that particular zone. It will be appreciated that other alarm preference orders may be employed without departing from the scope of the present disclosure.

In accordance with some embodiments of the present disclosure, the systems may be configured to perform a diagnostic or identification analysis on top of an alarm indicating an airborne contaminant is present. For example, upon detection of an airborne contaminant, a central unit or other associated processor may perform an analysis to predict possible or expected cause(s)/source(s) of such airborne contaminants as well as resultant odor in a particular zone. This prediction may be performed based on known information, a look-up table, preprogrammed data analysis, machine learning, or the like. For example, based on the intensity and combination of molecules or other aspects of a detected airborne contaminant, the central unit or other associated processing may make a prediction of the source material in addition to the location of the zone. As such, for example, a spill or leak of liquids from the HVAC system itself (e.g., oil, gas) may be distinguished from animal matter or airborne contaminants generated by living creatures. The alert or alarm generated by the system may thus provide such additional predictive information to a maintenance person and such person may be better prepared for a service operation.

In accordance with embodiments of the present disclosure, the position and location of sensor elements is mapped to a ducting model. From this, when a sensor element detects the presence of an airborne contaminant, the specific location of such detection may be obtained. Based on the individual detection and any downstream intensity level monitoring, the scope of a source of an airborne contaminant may be determined. Further, based on this information, targeted servicing and/or inspection may be achieved, thus saving time and costs associated with downtime (e.g., HVAC off) and the service operation (e.g., finding and correcting any identified issues).

Advantageously, embodiments described herein provide for improved airborne contaminant detection within HVAC systems, including odors and other contaminants. As such, improved air quality within a building or indoor space(s) associated with an HVAC system may be achieved. Further, advantageously, targeted servicing of HVAC systems subject to airborne contaminants may be achieved through identification of airborne contaminants and localization information. From this, an alert, alarm, or notification may be generated with respect to a specific, identifiable zone or section of HVAC ducting (and associated indoor spaces). As such, inspection and correction of sources of airborne contaminants may be quickly and efficiently addressed.

The use of the terms "a", "an", "the", and similar references in the context of description (especially in the context of the following claims) are to be construed to cover both the singular and the plural, unless otherwise indicated herein or specifically contradicted by context. The modifiers "about" and "substantially" used in connection with a quantity (absolute or relative) is inclusive of the stated value and has the meaning dictated by the context (e.g., it includes the degree of error associated with measurement of the particular quantity). All ranges disclosed herein are inclusive of the endpoints, and the endpoints are independently combinable with each other. As used herein, the terms "about" and "substantially" are intended to include the degree of error associated with measurement of the particular quantity based upon the equipment available at the time of filing the application. For example, the terms may include a range of +8%, or 5%, or 2% of a given value or other percentage change as will be appreciated by those of skill in the art for the particular measurement and/or dimensions referred to herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An airborne contaminant detection and localization system comprising:

a heating, ventilation, and air conditioning (HVAC) system having a duct configured to convey air therethrough;

a first vent configured to fluidly connect the duct to a first indoor space of one or more indoor spaces;

a second vent configured to fluidly connect the duct to a second indoor space of the one or more indoor spaces, wherein the second indoor space is different from the first indoor space and wherein the second vent is located downstream from the first vent in a flow direction along the duct; and a monitoring system comprising:

a first sensor element arranged proximate the first vent, the first sensor element configured to detect one or more airborne contaminants;

a second sensor element arranged proximate the second vent, the second sensor element configured to detect the one or more airborne contaminants; and a central unit configured to receive sensor data from the first sensor element and the second sensor element, wherein the central unit includes information regarding a location of each of the first sensor element and the second sensor element within the duct, the central unit configured to:

determine a presence of an airborne contaminant in the duct from the sensor data;

determine an intensity of the airborne contaminant at each of the first sensor element and the second sensor element;

establish a detection zone that includes a portion of the duct having a highest detected intensity of the airborne contaminant, wherein the detection zone comprises a portion of the duct upstream from the respective sensor having the highest detected intensity of the airborne contaminant;

generate an alert comprising the detection of the airborne contaminant and the detection zone; and transmit said alert to a service technician indicating the presence of the airborne contaminant and a location of the detection zone.

2. The airborne contaminant detection and localization system of claim 1, wherein the central unit is configured to compare the intensity of the airborne contaminant at each of the first sensor element and the second sensor element to determine a location of a source of the airborne contaminant.

3. The airborne contaminant detection and localization system of claim 1, wherein the duct is a supply duct, the system further comprising:

a return duct;

a first return vent configured to direct air from the first indoor space into the return duct;

a second return vent configured to direct air from the second indoor space into the return duct; and the monitoring system further comprises:

a third sensor element arranged proximate the first return vent, the third sensor element configured to detect the one or more airborne contaminants;

a fourth sensor element arranged proximate the second return vent, the fourth sensor element configured to detect the one or more airborne contaminants; and the central unit is configured to determine a source of the detected airborne contaminant based on sensor data from the first, second, third, and fourth sensor elements.

4. The airborne contaminant detection and localization system of claim 1, wherein each of the first sensor element and the second sensor element comprise a respective sensor array.

5. The airborne contaminant detection and localization system of claim 1, wherein each of the first sensor element and the second sensor element are configured to detect the presence of at least one of $NO_x$, $H_2S$, $CH_4$ (methane), Ammonia, Methanethiol, Phosgene, $SO_x$, Chlorine, or Volatile Organic Compounds.

6. The airborne contaminant detection and localization system of claim 1, further comprising:

a plurality of additional sensor elements arranged in the duct; and a plurality of additional vents, wherein each vent of the plurality of additional vents has one sensor element of the plurality of additional sensor elements associated therewith.

7. The airborne contaminant detection and localization system of claim 1, wherein the first sensor element is arranged upstream from the first vent and the second sensor element is arranged upstream from the second vent.

8. The airborne contaminant detection and localization system of claim 1, wherein the first sensor element is arranged downstream from the first vent and the second sensor element is arranged downstream from the second vent.

9. The airborne contaminant detection and localization system of claim 1, wherein the central unit includes a database of the position and location of each of the first sensor element and the second sensor element as mapped to a ducting model representing the duct.

10. The airborne contaminant detection and localization system of claim 1, wherein the one or more airborne contaminants include at least one odor.

11. The airborne contaminant detection and localization system of claim 1, wherein the duct is a supply duct of the HVAC system.

12. A method of detecting and identifying a location of an airborne contaminant within a heating, ventilation, and air conditioning (HVAC) system, the method comprising:

monitoring a first detection zone of a duct with a first sensor element, the first detection zone comprising a first section of the duct, the first sensor element, and at least one first vent, wherein the at least one first vent is configured to provide fluid connection between the duct and a first indoor space;

monitoring a second detection zone of the duct with a second sensor element, the second detection zone comprising a second section of the duct, the second sensor element, and at least one second vent, wherein the at least one second vent is configured to provide fluid connection between the duct and a second indoor space;

mapping locations of the first sensor element and the second sensor element within the duct;

determining a presence of the airborne contaminant within at least one of the first detection zone and the second detection zone based on sensor data received from the respective first sensor element and second sensor element, wherein the first detection zone comprises a location of the first sensor element and a section of the duct upstream from the first sensor element and the second detection zone comprises a location of the second sensor element and a section of the duct upstream from the second sensor element;

determining an intensity level of the airborne contaminant;

generating an alert including a detection zone having a highest intensity level from the first detection zone and the second detection zone; and transmitting said alert to a service technician indicating the presence of the airborne contaminant and a location of the detection zone having the highest intensity level.

13. The method of claim 12, further comprising comparing the intensity of the airborne contaminant at each of the first sensor element and the second sensor element to determine a location of a source of the airborne contaminant.

14. The method of claim 12, wherein the HVAC system comprises a return duct, a first return vent configured to direct air from the first indoor space into the return duct, and a second return vent configured to direct air from the second indoor space into the return duct, the method further comprising:

monitoring a first detection zone of the return duct with a third sensor element, the first detection zone of the return duct comprising a first section of the return duct, the third sensor element, and at least one first return vent, wherein the at least one first return vent is configured to direct air from the first indoor space into the return duct;

monitoring a second detection zone of the return duct with a fourth sensor element, the second detection zone of the return duct comprising a second section of the return duct, the fourth sensor element, and at least one second return vent, wherein the at least one second return vent is configured to direct air from the second indoor space into the return duct; and determining a source of the detected airborne contaminant based on sensor data from the first, second, third, and fourth sensor elements.

15. The method of claim 12, wherein each of the first sensor element and the second sensor element comprise a respective sensor array.

16. The method of claim 12, wherein each of the first sensor element and the second sensor element are configured to detect the presence of at least one of $NO_x$, $H_2S$, $CH_4$ (methane), Ammonia, Methanethiol, Phosgene, $SO_x$, Chlorine, or Volatile Organic Compounds.

17. The method of claim 12, wherein the HVAC system further comprises: a plurality of additional sensor elements arranged in the duct; and a plurality of additional vents, wherein each vent of the plurality of additional vents has one sensor element of the plurality of additional sensor elements associated therewith, wherein the method further comprises:

monitoring a respective detection zone of the duct associated with each of the plurality of additional sensor elements;

mapping locations of each of the plurality of additional sensor elements within the duct;

determining a presence of the airborne contaminant within at least one of the respective detection zones based on sensor data received from a respective additional sensor element;

determining an intensity level of the airborne contaminant; and generating an alert including the detection zone having a highest intensity level from the plurality of detection zones.

18. The method of claim 12, further comprising mapping and generating a database of a position and location of each of the first sensor element and the second sensor element as mapped to a ducting model representing the duct.

19. The method of claim 12, wherein the one or more airborne contaminants include at least one odor.

20. The method of claim 12, wherein the duct is a supply duct of the HVAC system.

* * * * *